United States Patent [19]

Gerber

[11] Patent Number: 4,643,061

[45] Date of Patent: Feb. 17, 1987

[54] ROTARY BLADE SHEET MATERIAL CUTTER WITH SHARPENER

[75] Inventor: Heinz J. Gerber, West Hartford, Conn.

[73] Assignee: Gerber Scientific Inc., South Windsor, Conn.

[21] Appl. No.: 739,422

[22] Filed: May 30, 1985

[51] Int. Cl.[4] ..... B26D 7/12

[52] U.S. Cl. ..... 83/174.1; 51/247; 83/925 CC

[58] Field of Search ..... 83/174, 174.1, 925 CC; 51/246, 247, 249; 30/139

[56] References Cited

U.S. PATENT DOCUMENTS

| | | | |
|---|---|---|---|
| 1,795,781 | 3/1931 | Komow | 51/247 |
| 1,852,397 | 4/1932 | Berger | 83/174 |
| 3,328,927 | 7/1967 | Mason et al. | 51/247 |
| 3,512,437 | 5/1970 | Enneper et al. | 83/174.1 |
| 4,347,771 | 9/1982 | Bradley | 83/174 |
| 4,362,077 | 12/1982 | Gerber | 83/925 CC |
| 4,442,599 | 4/1984 | Clark | 83/174 |

*Primary Examiner*—Frank T. Yost
*Assistant Examiner*—Hien H. Phan
*Attorney, Agent, or Firm*—McCormick, Paulding & Huber

[57] ABSTRACT

A cutter for cutting fabric and similar sheet materials spread on a supporting surface includes a rotary cutting blade and an associated sharpening element in the form of a rotary sharpening disk or similar element. A simplified sharpening apparatus and procedure is obtained wherein both the cutting blade and the sharpening element are continuously driven by a single drive motor and wherein the sharpening element is periodically moved along its axis of rotation into and out of sharpening engagement with the cutting blade to sharpen or renew the edge on the blade, such a sharpening event if desired occuring while the blade remains in cutting relation with the material being cut.

5 Claims, 4 Drawing Figures

ROTARY BLADE SHEET MATERIAL CUTTER WITH SHARPENER

BACKGROUND OF THE INVENTION

This invention relates to cutters for cutting fabric and other similar flexible sheet material spread on a supporting surface, and deals more particularly with such a cutter using a rotary cutting blade as the cutting tool and having associated with it an improved sharpening mechanism for sharpening the edge of the blade while the blade remains in the cutter.

Copending U.S. patent application Ser. No. 736,839, entitled "APPARATUS AND METHOD FOR SUPPORTING AND WORKING ON SHEET MATERIAL", filed May 22, 1985, and assigned to the same assignee as this application, discloses a cutting machine using a cutter of the type to which this invention pertains, and reference may be made to that application for further details of the overall cutting machine and system. As to the cutter itself, however, it uses a relatively small diameter circular cutting blade rotated at high speed about a horizontal axis and moved along desired lines of cut with respect to work material spread on a horizontal support surface, the cutter blade also being rotated about a vertical theta axis during such movement to maintain it tangent to the line of cut. As the cutting progresses, the cutting edge of the blade inevitably becomes worn or dulled and it is therefore desirable to provide some means for sharpening the blade from time to time without having to remove the blade from the cutter for the sharpening procedure, and also preferably without having to stop the cutting procedure when the sharpening occurs. That is, it is desirable to be able to perform the sharpening "on the fly".

In the past various different sharpening devices have been proposed for sharpening rotary cutting tools, but in general these have been of relatively complicated construction, often they are not productive of a good sharpening effect and in most cases they are not such as to lend themselves well to use with a small cutter blade having a diameter on the order of one inch or less.

The general object of this invention is therefore to provide a rotary blade cutter for fabric or similar sheet material including a sharpener for periodically sharpening the cutting edge of the blade, which sharpener is of simple, low cost construction, reliable in operation, productive of an excellent sharpening effect, and particularly well adapted for use with thin, small diametered cutting blades.

Other objects and advantages of the invention will be apparent from the following description of a preferred embodiment of the invention and from the accompanying drawings.

SUMMARY OF THE INVENTION

The invention resides in a sheet material cutter having a rotary cutting blade rotatable about a first axis and a rotary sharpening element, such as a disk, having a generally radial sharpening face rotatable about a second axis. The two axes are so arranged that the sharpening face of the sharpening element may be brought into and out of sharpening engagement with the cutting blade by moving the sharpening element generally axially along its axis of rotation. A single drive motor continuously rotates both the cutting blade and the sharpening element and an associated actuating means periodically moves the sharpening element into and out of engagement with the cutting blade to periodically sharpen the blade's cutting edge. The rotary motion imparted to the blade by the drive motor is used in the cutting of sheet material and a sharpening event may occur while the cutting blade is in the process of making a cut without interrupting, slowing down or otherwise interfering with the cutting process.

The invention also resides in the construction of the means for driving the cutting blade and the sharpening element and in other specific features defined by the claims.

DETAILED DESCRIPTION OF THE PREFERRED EMBODIMENTS

Figure 1:
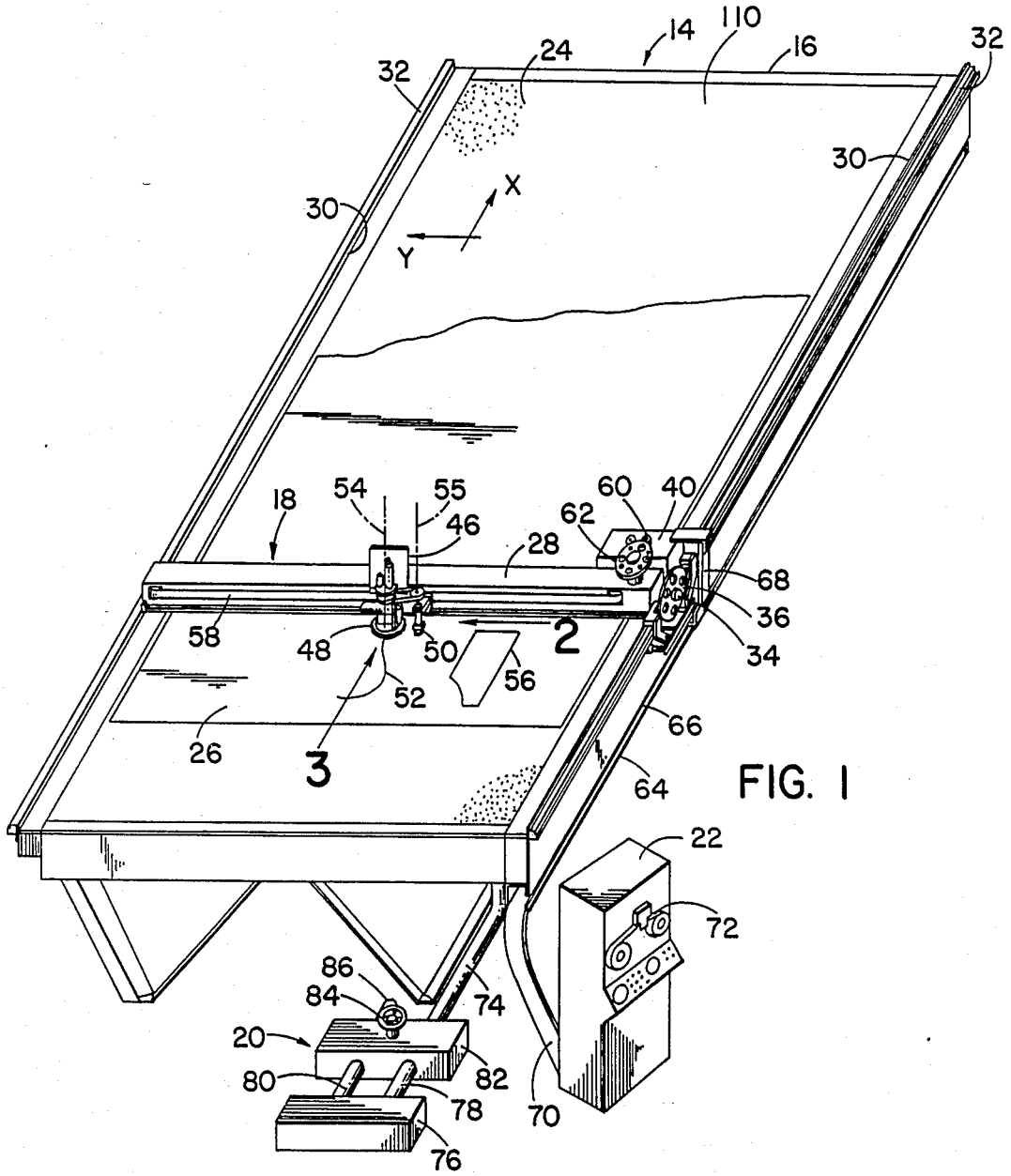
FIG. 1 is a perspective view showing a cloth cutting machine having a cutter embodying the present invention.

Turning to FIG. 1, a rotary blade cutter 48 embodying the invention is there shown as part of an apparatus 14 adapted to the cutting of either a single layer or a layup of sheet material spread on a work supporting surface. The apparatus by way of major components is comprised of a cutting table 16, a cutting mechanism 18, an air system 20 and a numerical controller 22.

The table 16 has an elongated, rectangular, horizontal and upwardly facing work support surface 24 which in the illustrated case is used to support a single sheet of cloth 26, as the work material, in a spread condition. The work support surface 24 is provided by a bristle bed 110 having a large number of air transmitting passages extending vertically through it to allow air to pass between the work support surface 24 and hollow compartments underlying the surface 24 as part of a system for creating a vacuum over a selected area of the surface 24, to aid in holding in place the material 26 as it is cut, and also possibly for creating a positive air pressure over the entire extent of the surface 24 to aid in moving the material 26 onto or off of the surface 24.

The cutting mechanism 18 includes an X-carriage 28 located above the support surface 24 and moveable in the illustrated X-coordinate direction relative to the table 16. It is supported at its opposite ends by suitable bearings (not shown) engageable with upwardly projecting walls 30, 30 on opposite longitudinal sides of the table. On the outboard surface of each wall is a longitudinally extending rack 32. A drive shaft 34, having a drive gear 36 fixed to its right hand end, as seen in FIG. 1, extends through the carriage 28 and has a pinion (not shown) on each of its opposite ends engageable with the associated rack 32 to move the carriage in the X-direction in response to rotation of the drive gear 36 and the shaft 34. Carried by a service module 40 fixed to the right hand end of the X-carriage, as seen in FIG. 1, is an X-motor (not shown) having an output pinion which meshes with the drive gear 36.

Supported on the X-carriage 28 for movement relative to it in the illustrated Y-coordinate direction, is a Y-carriage 46 which carries the rotary blade cutter head 48 and also a reciprocating blade cutter head 50. As explained in more detail hereinafter, the head 48 has a blade rotatable about a generally horizontal axis, to cut the material 26 along a given line of cut 52 as the head 48 is moved along such line, under control of the controller 22, by combined movement of the X-carriage 28 and Y-carriage 46 in the X and Y-coordinate directions. During such movement the portion of the head 48 carrying the rotating blade is moveable about a vertical theta axis 54 to maintain the cutting blade tangent to the line of cut 52, and the vertically extending blade of the reciprocating blade cutter 50 is likewise moveable about a vertical theta axis 55. In general, the cutter head 48 is used to cut pattern pieces from the material 26 with one such pattern piece being shown for example at 56. The head 50 has a vertically moveable blade and may be used to cut notch marks in the pattern pieces cut by the cutter head 48. It can also be used to cut some portions of the lines of cut defining the pattern pieces as, for example, portions of such lines having curvatures smaller than easily cut by the rotary blade cutter head 48.

The Y-carriage 46 is moved in the Y-coordinate direction by a belt 58 passing over pulleys at the opposite ends of the Y-carriage 28. The right hand one of these pulleys, as seen in FIG. 1, is driven by a Y-motor (not shown) contained in the service module 40 and having a pinion 60 on its drive shaft which meshes with the a drive gear 62 in turn drivingly connected with the right hand belt pulley.

Power and electrical commands for operating the X and Y-drive motors in the service module 40 and for operating the cutter heads 48 and 50 are supplied from a ribbon cable contained in a cable housing 64 running along the right hand side of the table and having a longitudinally extending slot 66 providing access to the cable. One end of the cable is connected to a conductor carrying arm 68 connected to the X-carriage 28 and the other end of the cable is connected to the numerical controller 22 through a connecting cable 70 which may be a continuation of the cable contained in the housing 64.

The numerical controller 22 which may, as illustrated, operate in response to instructions recorded on magnetic tape 72, provides the power and commands needed to operate the cutting table 16, and in particular to move the cutter head 48 along the desired lines of cut on the work material 26.

The air system 20 is connected to the table through a supply conduit 74 and operates to selectively apply either a vacuum or positive air pressure to that conduit. In the illustrated case the distribution system is taken to be similar to that described and shown in my U.S. patent application Ser. No. 736,838, filed May 22, 1985 and titled "APPARATUS WITH BELT VALVE VACUUM SYSTEM FOR WORKING ON WORK MATERIAL" now U.S. Pat. No. 4,587,873, which application is incorporated herein by reference and to which reference may be made for further details.

Figure 2:
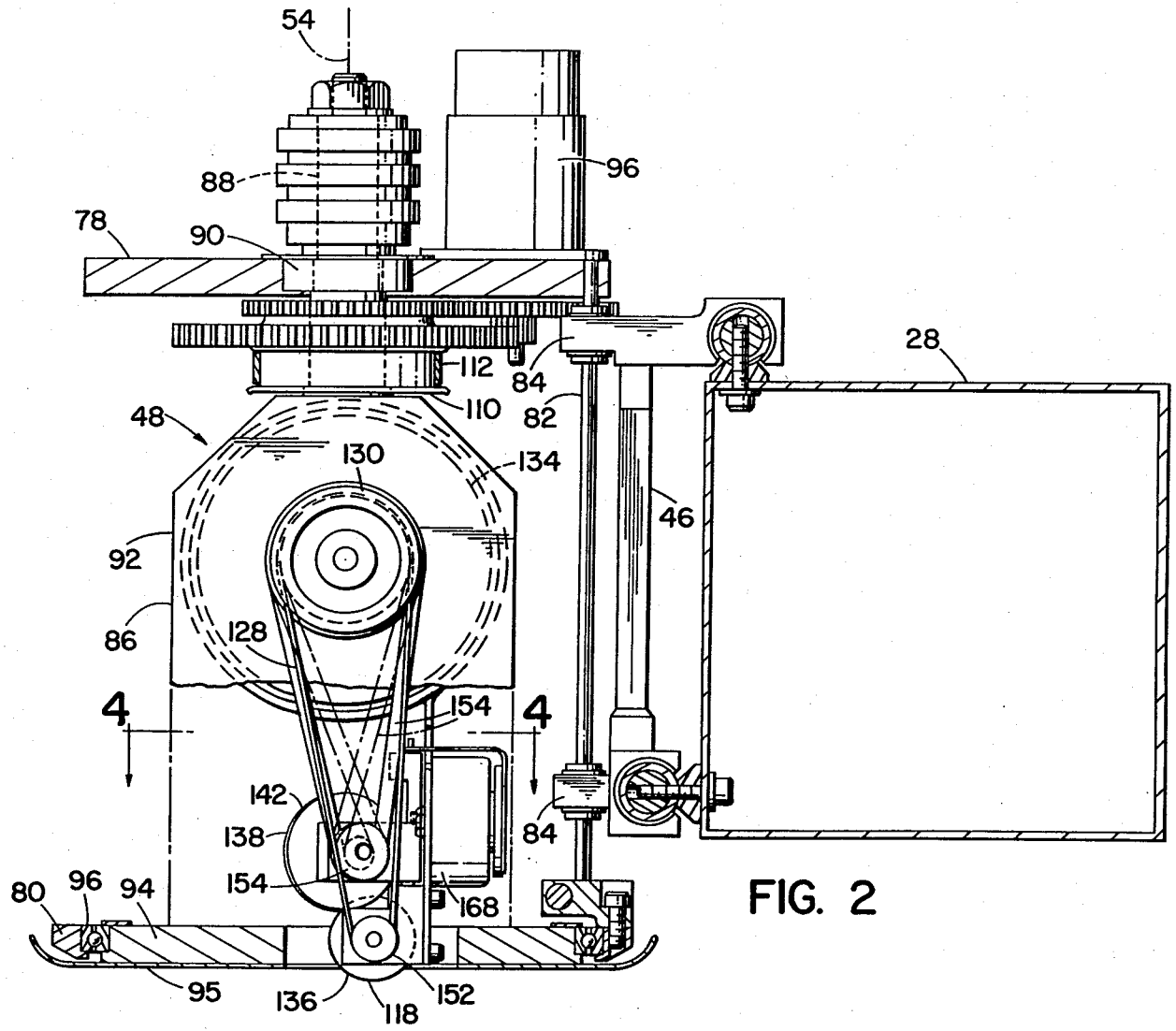
FIG. 2 is a side elevational view of the cutter of FIG. 1 taken looking generally in the direction of the arrow 2 of FIG. 1.
Figure 4:
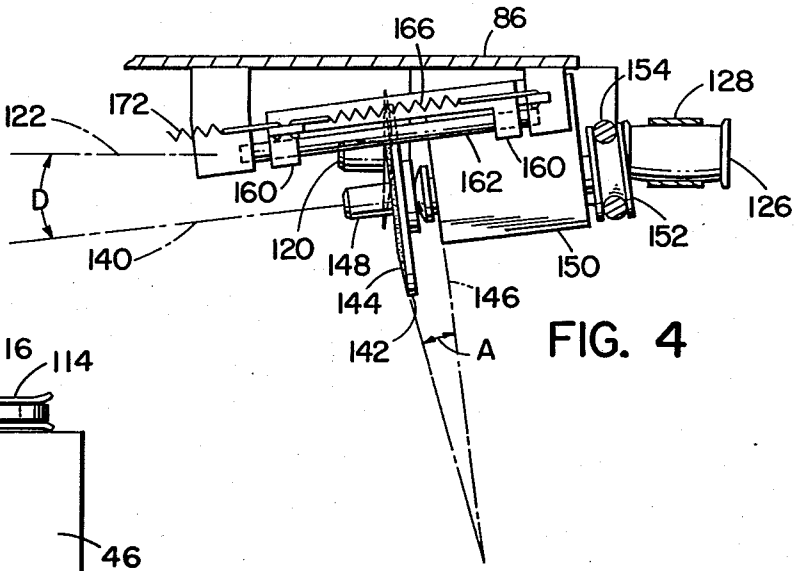
FIG. 4 is a view taken generally on the line 4—4 of FIG. 2 showing the inclination between the axes of the cutting blade and sharpening disk.
Figure 3:
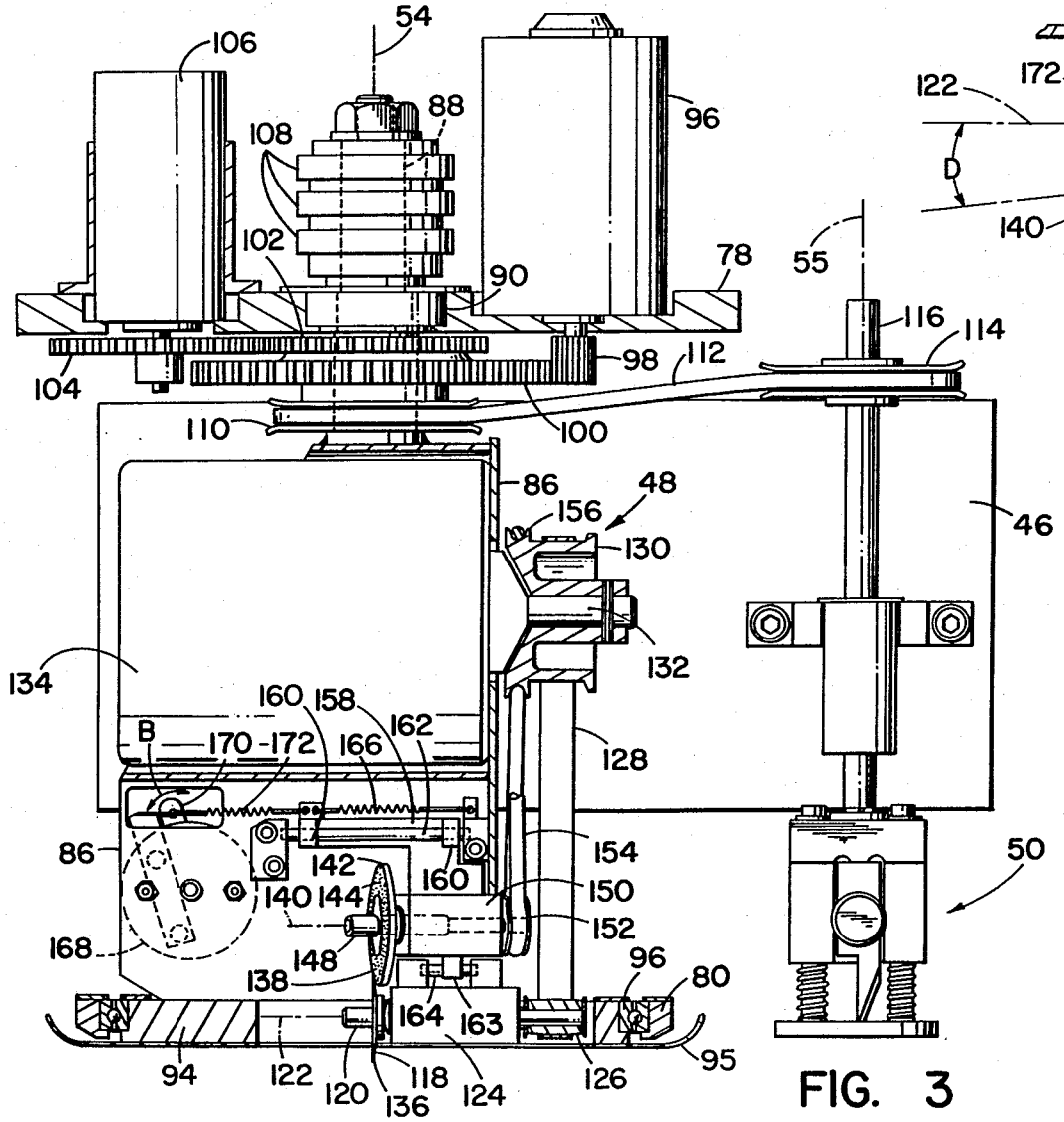
FIG. 3 is a front front elevational view of the cutter of FIG. 1 taken generally in the direction of the arrow 3 of FIG. 1.

Turning now to FIGS. 2, 3 and 4 for a more detailed description of the cutter head 48, this cutter head consists of an upper plate 78 and a lower plate 80 connected to one another by two vertically extending guide rods 82, only one of which is shown in FIG. 2 and which are omitted in FIG. 3 for clarity. The guide rods 82 are supported in bearings 84, 84 fixed to the Y-carriage 46 for vertical sliding movement. In FIGS. 2 and 3 the cutter head 48 is shown in its lowermost position relative to the Y-carriage 46 and from this position it can be raised by a suitable motor (not shown), to bring it out of cutting engagement with the sheet material 26.

Located primarily between the upper and lower parts 78 and 80, which are non-rotatable relative to the Y-carriage 46, is a cutter body 86 supported for rotation relative to the parts 78 and 80 about the theta axis 54. This body 86 includes an upwardly projecting stem 88 rotatably connected with the upper part 78 by a ball bearing unit 90, an intermediate frame 92 and a lower circular part 94 rotatably connected with the lower part 80 by a ball bearing unit 96. Connected to the bottom of the circular part 94 is a presser foot 95 the undersurface of which engages the top surface of the sheet material 26 during a cutting procedure.

The body 86 is rotated about the theta axis by a servo motor 96, under the control of the controller 22, having an output pinion 98 meshing with a drive gear 100 fixed to the stem 88. Also fixed to the stem 88 is another gear 102 meshing with a gear 104 fixed to the output shaft of a resolver 106, the resolver 106 serving to provide output signals to the controller 22 indicating the position of the body 86 relative to the theta axis 54. Fixed to the upper end of the stem 88 are a number of electrical slip rings 108 serving to conduct electrical power to the various electrically energized parts of the cutter mounted on the body 86.

Also fixed to the stem 88 is a toothed pulley 110 cooperating with a toothed belt 112 also trained over a toothed pulley 114 fixed to the shaft 116 of the cutter head 50 mounted to the Y-carriage 46. Therefore, in this manner the single servo motor 96 positions both the cutter head 48 and the cutter head 50 simultaneously and in unison about their respective theta axes 54 and 55. The construction of the cutter head 50 may be similar that shown in copending patent application Ser. No. 737,391, filed May 23, 1985 entitled "NOTCHING AND/OR DRILLING TOOL WITH PRESSER FOOT" to which reference may be made for further details.

In accordance with the invention the cutting tool of the cutter head 48 is a rotary blade 118 which is replaceably mounted onto a drive shaft 120 supported for rotation about a horizontal axis 122 fixed relative to the lower rotatable part 94 of the body 86, the shaft 120 being supported by suitable bearings for such rotation in a bearing block 124 fixed to the part 94. On the opposite end of the bearing block 124 from the blade 118 the shaft 120 extends out of the block and has fixed to it a drive pulley 126 driven by a belt 128 also passing over a drive pulley 130 fixed to the shaft 132 of a drive motor 134 carried by the body 86.

The rotary cutter blade 118 is preferably of relatively small diametral size, such as one inch or less in diameter, the blade 118 in the presently illustrated case being three quarters of an inch in diameter. It is also preferably quite thin and in the illustrated case is taken to have a maximum thickness of five thousandths of an inch. The blade may be made of various different materials and may for example be made of M2 steel. In situations where the blade may be used to cut vinyl or other sticky type material it may be desirable to make the blade of a low friction material such as polyond—a material comprised of a combination of electroless nickel and tetrafluroethylene.

The speed of the rotary blade may vary but in the preferred case it is driven at a relatively high speed such as one greater than fifteen thousand rpm.

Also in keeping with the invention, associated with the blade 118 is a simple but effective sharpening means for sharpening the circular cutting edge 136 of the blade periodically while the blade remains on the shaft 120 and, if desired, while the blade 118 remains in cutting engagement with the sheet material 26 being cut.

As shown in FIGS. 2, 3 and 4, this sharpening means includes a sharpening element 138 supported for rotation about a horizontal axis 140 located above the blade axis 122 and tilted relative to the axis 122 by a small angle, such as an angle of between five and ten degrees, as shown at D in FIG. 4. as seen in a horizontal plane. The sharpening element 138 may take various different forms but preferably and as illustrated consists of a disk 142 having a sharpening face 144. The sharpening face 144 is preferably slightly conical and as shown in FIG. 4 is such as to form an angle A with a line 146 perpendicular to the axis 140 of between five degrees and twenty degrees.

The sharpening disk 142 is replaceably mounted on a shaft 148 supported for rotation about the axis 140 by a bearing block 150 containing suitable bearings. At the end of the bearing block 150 opposite from the disk 142 the shaft 148 extends outwardly from the block and has fixed to it a drive pulley 152 cooperating with a drive belt 154 also passing over a pulley 156 fixed to the shaft 132 of the drive motor 134. The motor 134 has energized and deenergized states. When deenergized the motor shaft 132 is at rest and neither the cutter blade 118 or the sharpening disk 142 are rotated. On the other hand, when the motor 134 is energized its shaft 132 is continuously driven, thereby driving both pulleys 130 and 156 and continuously and simultaneously driving both the cutter blade 118 and the sharpening disk 142 through the associated belts 128 and 154.

As indicated best in FIG. 2 the belt 154 for the sharpening disk may be trained over its pulleys 156 and 152 in the manner shown by the solid lines of FIG. 2, in which case it drives the sharpening disk in one direction of rotation relative to the cutter blade 118, or it may also be trained over the pulleys 152 and 156 as shown by the broken lines of FIG. 2, in which case it drives the sharpening disk 142 in the opposite direction of rotation relative to the cutter blade 118. Slightly different sharpening effects are produced by each of the two possible directions of rotation of the sharpening disk relative to the cutter blade and each sharpening effect may be better suited than the other to the cutting of some materials. Therefore, the illustrated arrangement allows the direction of rotation of the sharpening disk relative to the cutter blade to be easily changed to best suit the material being cut. Likewise, the motor 134 is preferably a reversible one so that the output shaft 132 may be driven in either direction of rotation to suit the direction of rotation of the cutter blade 118 to the material being cut. That is, the cutter blade may be driven either clockwise or counter clockwise, as seen in FIG. 2, with the choice depending generally on which direction of rotation performs better for the particular material being cut.

The bearing block 150 for the sharpening disk 142 is supported for movement generally along the axis 140 of the sharpening disk to allow the sharpening disk to be moved into and out of sharpening engagement with the cutter blade 118.

The support and associated actuating means for the bearing block 150 is comprised of an upward extension 158 fixed to the block 150 and having two ears 160, 160 slideably received on a guide rod 162 fixed to the body 86 and a downward ear 163 slideably received on another guide rod 164 also fixed to the body 86. A spring 166, as seen in FIG. 3, urges the bearing block 150 to the right, as seen in FIG. 3 to a position at which the sharpening disk 142 is out of sharpening engagement with the cutting blade 118. From this position the bearing block is moveable to the left to a sharpening position at which the sharpening face 144 of the sharpening disk engages the rotary cutting blade 118. The movement of the bearing block 150 to the left and into sharpening engagement with the rotary cutting blade is effected by a rotary solenoid 168 having an operating arm 170 connected to the bearing block 150 through a spring 172 and moveable in the direction of the arrow B of FIG. 3. That is, when the solenoid is deenergized the arm is located at a rightward position as seen in FIG. 3, and when the solenoid is energized the actuating arm 170 moves in the counter clockwise direction and pulls the bearing block 150 against the force of the spring 166 into sharpening engagement with the rotary cutting blade 118, and after such engagement is made the spring 172 allows for some over travel of the actuating arm 170 until it reaches its counter clockwise limit position.

In FIGS. 2 and 3 for convenience of illustration the guide shafts 162 and 164, and the parts associated with them, are shown to extend along lines parallel to the axis 122 of the cutting blade 118. Preferably, however, but not necessarily, as shown in FIG. 4 the guide rod 162, as well as the guide rod 164 and the associated parts are arranged parallel to the axis 140 of the sharpening disk 142. That is, as mentioned, the axis 122 of the cutting blade 118 and the axis 140 of the sharpening disk 142 are arranged at an angle D relative to one another, as seen in a horizontal plane which angle is within the range of between five and ten degrees, and the bearing block moves along the axis 140.

The sharpening disk 142 may be of various different sizes, but preferably is of a diametral size approximately the same as or slightly larger than that of the cutting blade 118. In the illustrated case where the cutting blade is taken to have a diameter of three quarters of an inch, the sharpening disk has a diameter of one inch. Also the material of the sharpening disk may vary but in an exemplary case the disk is made of a base body of metal such as steel with the sharpening face 144 being provided by a coating containing abrasive particles such as particles of borazon.

From the foregoing description of the construction of the cutter head 48 it will be understood that the operation of the sharpener in cooperation with the cutter blade is as follows. During a normal cutting operation the cutting head 48 is lowered to bring the presser foot 95 into engagement with the sheet material 26 and in such position the lower portion of the cutting blade 118 passes through the sheet material 26 and into the bristle bed 110. The drive motor 134 is energized to rotate the cutting blade 118 and the cutter is moved along a line of cut 52, with the servo motor 96 positioning the cutter body 86 about the theta axis 54 to maintain the blade tangent to the line 52. At the same time the drive motor 134 also rotates the sharpening disk 142. Normally, the sharpening disk is kept out of contact with the cutting blade 118, but periodically it may be moved into and then, after a brief time, back out of engagement with the blade 118, to sharpen or renew the blade's cutting edge 136, by shifting the bearing block to the left and then to the right as seen in FIG. 3. During the actual sharpening event the blade 118 and sharpening disk 142 are positively driven relative to one another and since the disk 142 is located above the cutting zone of the cutting blade 118 the sharpening can occur without having to withdraw the cutting blade 118 from the material 26 or without in any other way interfering with the cut in progress. The timing of the sharpening event is controlled by the controller 22 and may for example be such that a sharpening event is dictated every time the cutting blade has completed cutting some prescribed length of cut on the material 26.

I claim:

1. In a sheet material cutter having a powered rotary cutting blade, the combination comprising:

a rotary cutting blade rotatable about a first axis, a rotary shafpening element with a sharpening face rotatable about a second axis, a single drive motor having energized and deenergized states, means drivingly connecting both said rotary cutting blade and said rotary sharpening element to said single drive motor for causing both said cutting blade and said sharpening element to be driven continuously about said first and second axes respectively when said drive motor is in its energized state, and means for periodically moving said sharpening element relative to said cutting blade to first bring said sharpening face into and then back out of sharpening engagement with said cutting blade while said single drive motor remains in its energized state and drives both said cutting blade and said sharpening element about said first and second axes respectively, said means for drivingly connecting both said cutting blade and said sharpening element to said single drive motor comprising said single drive motor having a rotary output shaft, a first drive shaft supporting said rotary cutting blade for rotation about said first axis, a second drive shaft supporting said rotary sharpening element for rotation about said second axis, first and second pulleys fixed to said output shaft of said drive motor, a third pulley fixed to said first drive shaft, a fourth pulley fixed to said second drive shaft, a first drive belt trained over said first and third pulleys to drivingly connect said motor to said rotary cutting blade and a second drive belt trained over said second and fourth pulleys to drivingly connect the said motor to said rotary sharpening element.

2. The combination defined in claim 1 further characterized by at least one of said first and second belts being reversible relative to the two pulleys over which it is trained to reverse the direction of rotation of said rotary cutting blade relative to said rotary sharpening element.

3. The combination defined in claim 2 further characterized by said single drive motor being reversible to reverse the direction in which said rotary cutting blade rotates about said first axis.

4. In a sheet material cutter having a powered rotary cutting blade, the combination comprising:

a rotary cutting blade rotatable about a first axis, a rotary sharpening element with a sharpening face rotatable about a second axis, a single drive motor having energized and deenergized states, means drivingly connecting both said rotary cutting blade and said rotary sharpening element to said single drive motor for causing both said cutting blade and said sharpening element to be driven continuously about said first and second axes respectively when said drive motor is in its energized state, and means for periodically moving said sharpening element relative to said cutting blade to first bring said sharpening face into and then back out of sharpening engagement with said cutting blade while said single drive motor remains in its energized state and drives both said cutting blade and said sharpening element about said first and second axes respectively, said means for moving said sharpening element into and out of engagement with said cutting blade including a support block, a drive shaft supported by said support block for rotation about said second axis relative to said support block and restrained against axial movement relative to said support block, means attaching said sharpening element to said drive shaft, slide means supporting said support block for sliding movement parallel to said second axis relative to said cutting blade, a spring means biasing said support block to a first position relative to said cutting blade at which first position said sharpening face of said sharpening element is out of engagement with said cutting blade and resiliently resisting movement of said support block toward a second position at which said sharpening face of said sharpening element is in engagement with said cutting blade, and an actuating means having energized and deenergized states and operable when switched from its deenergized to its energized state to move said support block from said first position to said second position against the biasing force of said spring means to bring said sharpening face into sharpening engagement with said cutting blade, and said means for drivingly connecting both said cutting blade and said sharpening element to said single drive motor comprising said single drive motor having a rotary output shaft, a drive shaft supporting said rotary cutting blade for rotation about said first axis, first and second pulleys fixed to said output shaft of said drive motor, a third pulley fixed to said drive shaft supporting said cutter blade, a fourth pulley fixed to said drive shaft supporting said sharpening element, a first drive belt trained over said first and third pulleys to drivingly connect said motor to said rotary cutting blade, and a second drive belt trained over said second and fourth pulleys to drivingly connect said motor to said sharpening element.

5. In a sheet material cutter having a powered rotary cutting blade, the combination comprising:

a rotary cutting blade rotatable about a first axis, a rotary sharpening element with a sharpening face rotatable about a second axis, a single drive motor having energized and deenergized states, means drivingly connecting both said rotary cutting blade and said rotary sharpening element to said single drive motor for causing both said cutting blade and said sharpening element to be driven continuously about said first and second axes respectively whenever said drive motor is in its energized state, means for periodically moving said sharpening element relative to said cutting blade to first bring said sharpening face into and then back out of sharpening engagement with said cutting blade while said single drive motor remains in its energized state and drives both said cutting blade and said sharpening element about said first and second axes respectively, and means supporting said sharpening element for movement relative to said cutting blade along said second axis, said means for periodically moving said sharpening element having means operable to move said sharpening element back and fourth along said axis to bring said sharpening face into and out of engagement with said cutting blade, and said first and second axes being located respectively in first and second horizontal planes vertically spaced from one another, and said first and second axes being tilted relative to one another as seen in a horizontal plane by an angle of between five degrees and ten degrees, said sharpening face of said sharpening element being conical about said second axis and havng an angle of between five degrees and twenty degrees with respect to a line perpendicular to said second axis.

* * * * *